US005858208A

United States Patent [19]

Flanders et al.

[11] Patent Number: 5,858,208

[45] Date of Patent: Jan. 12, 1999

[54] METHODS FOR IMPROVING CONVERSION IN FLUIDIZED CATALYTIC CRACKING UNITS

[75] Inventors: Robert L. Flanders, San Anselmo, Calif.; Roy W. Greenlee, St. Louis, Mo.; George G. Duggan, Fenton, Mo.; Michael J. Zetlmeisl, St. Louis, Mo.

[73] Assignee: Baker Hughes Incorporated, Houston, Tex.

[21] Appl. No.: 858,178

[22] Filed: Feb. 25, 1997

Related U.S. Application Data

[63] Continuation-in-part of Ser. No. 286,044, Aug. 4, 1994, abandoned.

[51] Int. Cl.[6] ..... C10G 11/00

[52] U.S. Cl. ..... 208/121; 208/122; 208/123; 502/516; 502/521

[58] Field of Search ..... 502/521, 516, 502/85; 208/121, 122, 123

[56] References Cited

U.S. PATENT DOCUMENTS

| | | | |
|---|---|---|---|
| 2,273,234 | 2/1942 | Tanner | 148/6.5 |
| 2,315,080 | 3/1943 | Reid | 196/10 |
| 2,316,078 | 4/1943 | Loane | 252/48 |
| 2,316,091 | 4/1943 | White | 252/48 |
| 2,367,468 | 1/1945 | Mixon et al. | 252/48 |
| 2,375,315 | 5/1945 | Mixon | 252/352 |
| 2,377,955 | 6/1945 | Mixon et al. | 252/48 |
| 2,483,800 | 10/1949 | Zimmer et al. | 252/33.2 |
| 2,490,638 | 12/1949 | Kubee | 40/154 |
| 2,496,508 | 2/1950 | Watson et al. | 252/48.2 |
| 2,507,731 | 5/1950 | Mixon et al. | 260/139 |
| 2,516,119 | 7/1950 | Hersh | 260/139 |
| 2,597,750 | 5/1952 | Roberts et al. | 252/46.6 |
| 2,616,904 | 11/1952 | Asseff et al. | 260/399 |
| 2,616,905 | 11/1952 | Asseff et al. | 260/399 |
| 2,647,889 | 8/1953 | Watson et al. | 260/139 |
| 2,688,612 | 9/1954 | Watson | 260/139 |
| 2,717,265 | 9/1955 | Johnson | 260/504 |
| 2,723,235 | 11/1955 | Asseff et al. | 252/32.7 |
| 2,723,236 | 11/1955 | Asseff et al. | 252/32.7 |
| 2,726,261 | 12/1955 | Martin | 260/504 |
| 2,777,874 | 1/1957 | Asseff et al. | 260/504 |
| 2,794,829 | 6/1957 | van der Waarden et al. | 260/505 |
| 2,832,801 | 4/1958 | Bernstein | 260/505 |
| 2,901,419 | 8/1959 | Brill | 502/521 |
| 2,915,517 | 12/1959 | Le Suer | 260/139 |
| 3,225,086 | 12/1965 | Sias et al. | 260/504 |
| 3,337,613 | 8/1967 | Luberoff | 260/505 |
| 3,351,655 | 11/1967 | Seifert | 260/505 |
| 3,793,201 | 2/1974 | Karn | 252/33.4 |
| 3,865,737 | 2/1975 | Kemp | 252/33.4 |
| 4,094,801 | 6/1978 | Forsberg | 252/33 |
| 4,163,728 | 8/1979 | Cheng et al. | 252/18 |
| 4,226,739 | 10/1980 | Cheng et al. | 252/389 R |
| 4,253,976 | 3/1981 | Forsberg | 252/33 |
| 4,260,500 | 4/1981 | Forsberg | 252/33 |
| 4,264,363 | 4/1981 | Cech | 106/14.28 |
| 5,096,568 | 3/1992 | Cymbaluk et al. | 502/521 |

FOREIGN PATENT DOCUMENTS

| | | | |
|---|---|---|---|
| 133570 | 1/1979 | Germany | C10G 9/46 |
| 985180 | 3/1965 | United Kingdom . | |
| 1602098 | 11/1981 | United Kingdom | C07C 4/04 |

OTHER PUBLICATIONS

Vanadium Poisoning of Cracking Cataylsts:Mechanisms of Poisoning and Design of Vanadium Tolerant Catalyst System, Wormsbecher et al., Journal of Catalysts 100, 130–137 (1986) (no month).

*Primary Examiner*—Walter D. Griffin
*Attorney, Agent, or Firm*—Howell & Haferkamp, L.C.

[57] ABSTRACT

The present invention, therefore, is directed to a novel method for improving conversion in a fluidized catalytic cracking unit feed stream containing vanadium. According to the method, an effective amount of a composition comprising at least one overbase complex of a magnesium or aluminum salt or a mixture thereof and an organic acid complexing agent is incorporated into the feed stream.

21 Claims, No Drawings

METHODS FOR IMPROVING CONVERSION IN FLUIDIZED CATALYTIC CRACKING UNITS

This is a continuation-in-part application of application U.S. Ser. No. 08/286,044, filed Aug. 4, 1994, now abandoned.

BACKGROUND OF THE INVENTION

1. Field of the Invention

This invention relates to fluidized catalytic cracking during crude oil refining, and more particularly to improvement of conversion in fluidized catalytic cracking units supplied by feed streams contaminated with vanadium.

2. Description of the Prior Art

In general, a typical petroleum refinery includes a tank farm or storage area where crude petroleum and certain intermediates are held for optimum utilization by the refinery. The crude unit typically contains a desalter followed by a series of distillation columns whose principal function is to separate the crude oil feedstock into its various principal component fractions by differences in boiling point. The more volatile fractions are removed in the crude distillation tower leaving heavier gas oil fractions residual which are usually transported to a fluidized catalytic cracking (FCC) unit. Some of the bottom or residual fractions is also frequently included in the FCC feed. The FCC feed thus comprises various gas oil cuts and residual material and is routed to a pre-heat heat exchanger arrangement that comprises one or more heat exchangers and then a pre-heat furnace before introduction to the reactor of the FCC unit. Catalytic cracking typically employs a fluidized catalytic cracking unit which comprises a reactor containing a riser and a fluidized bed of catalyst, wherein the actual cracking process occurs, and a regenerator wherein catalyst is reactivated by burning coke and other residual materials from the surface of the catalyst. The products resulting from the cracking process, principally motor fuel blending stocks such as diesel fuel, jet fuel, kerosene and gasoline, are separated via fractionation columns.

In the reactor of the FCC unit, large hydrocarbon molecules are converted to smaller ones for use as transportation fuels. The degree to which the larger molecules are broken down to the smaller molecules is referred to as the FCC conversion or "yield". Improved conversion, particularly with respect to gasoline, is of extreme importance to the industry. Due to the high manufacturing costs and product values and the immense production scale involved, extraordinary efforts and expenses are undertaken for even slight improvements in conversion. The reaction is catalyzed by a fluidized catalyst; particularly a high zeolite content catalyst, typically about 25% to about 35% zeolite in a clay-like matrix.

Often, the FCC feed is contaminated with vanadium originating in the crude oil being refined. Typically, unsatisfactorily high vanadium levels are due mostly to the residuum component of the FCC feed, but gas oil from a coker unit, if present, can be a major culprit as well. The vanadium tends to coat the catalyst surface in the reactor and, in the regenerator, oxidize to a form in which it reacts readily with the catalyst to form low melting eutectics. As a result, the activity of the catalyst is impaired irreversibly by clogging of the catalyst pores. Accordingly, as vanadium levels build up in the reactor from the contaminated feed, FCC conversion is suppressed. See *Vanadium Poisoning of Cracking Catalysts:Mechanisms of Poisoning and Design of Vanadium Tolerant Catalyst System,* Wormsbecher et al., Journal of Catalysts 100, 130–137 (1986).

Conventionally, therefore, the problem of catalyst deterioration is addressed by a variety of techniques, none of which has been found to be wholly satisfactory. For example, the catalyst may be replaced or additional catalyst may be added, but this involves the obvious waste and costs. Additives also have been employed in certain attempts to fight vanadium contamination. Thus, tin compositions and solid particle vanadium scavengers have been used. However, tin compositions are very expensive and of only questionable efficacy. Since solid particle vanadium scavengers are solid, they are difficult to add to a feed stream, to disperse in the stream and to maintain them in dispersion through the stream. Moreover, special equipment is required for the handling and injection of the solid particles.

Many patents have been issued for improving hydrocarbon processes by alteration or modification of process conditions and/or equipment. Some patents have issued which relate to improved hydrocarbon processing by the use of process additive materials. Thus, British Application No. 985,180, published Mar. 3, 1965, discloses the use of alkaline earth metal salts of sulfonic acid or thiophosphonic acid to compatibilize feedstocks. Further, British Patent No. 1,602,098 discloses the addition of an alkaline earth metal oxide to a reactor to prevent deposit formation during the cracking of hydrocarbons. Also, German Patent No. 133,570 discloses the addition of alkaline earth metal sulfonates and sulfides to crude hydrocarbon refinery steams to inhibit coke deposition. Further, an overbase complex of calcium carbonate and a calcium salt of a sulfonic acid complexing agent and an overbase complex of magnesium oxide and the magnesium salt of a sulfonic acid have been used in treating crude oil in a refinery, although not for treatment of the FCC feed or for scavenging vanadium, but rather as pre-distillation column or fractionator additives.

Thus, in spite of the many changes and improvements to refinery systems over the years, the industry is still searching for techniques to improve conversion, for more satisfactory vanadium scavengers and for more satisfactory techniques for improving FCC catalyst life.

SUMMARY OF THE INVENTION

The present invention, therefore, is directed to a novel method for improving conversion in a fluidized catalytic cracking unit feed stream containing vanadium. According to the method, an effective amount of a composition comprising at least one overbase complex of a magnesium or aluminum salt or a mixture thereof and an organic acid complexing agent is incorporated into the feed stream.

In another aspect, the invention is directed to a novel method for scavenging vanadium from such streams by such techniques.

The invention also is directed to a novel method for prolonging the life of the FCC catalyst by such techniques.

Among the several advantages of this invention may be noted the provision of a method that improves FCC conversion; the provision of such method that improves FCC conversion with particular respect to gasoline; the provision of such method that scavenges vanadium; the provision of such method that prolongs the life of the FCC catalyst; the provision of such method that does not involve the drawbacks of solid vanadium scavengers; and the provision of such method that is relatively simple and economical.

DESCRIPTION OF PREFERRED EMBODIMENTS

In accordance with the present invention, it has been found that incorporating into fluidized catalytic cracking (FCC) unit feed streams a composition that comprises at least one overbase complex of a magnesium salt and an organic acid complexing agent result in surprisingly higher FCC conversion, particularly of gasoline. It is believed that an aluminum salt may be substituted for some or all of the magnesium salt with efficacy. Although not wishing to be bound to an particular theory, the inventors believe that the high conversion is a result of a reaction of the overbase with oxidized vanadium present on the catalyst as a result of a feed contaminant. This reaction competes with the reaction between the vanadium and the zeolite catalyst, thereby preventing or mitigating the latter reaction. It is believed that the overbase coats the catalyst, thereby being available on the catalyst surface for reaction with the vanadium as needed. Thus, it is believed that the magnesium (or aluminum) overbase reacts with vanadium to form a high-melting magnesium (or aluminum) vanadate before the vanadium can react with the zeolite. The reaction of MgO with vanadium in its oxidized form is reported in the Wormsbecher article noted above. Therefore, it is further believed that this technique provides a method for scavenging the vanadium in the feed and prolonging catalyst life as well. Moreover, because the overbase is a liquid colloidal dispersion and is "oil-soluble" in the sense that it remains dispersed at least as a colloidal suspension rather than settling out, it avoids the problems otherwise encountered with solid additives.

The additive composition of this invention may be incorporated into the feed at any of various injection points. Thus, it may be incorporated in the hot feed to the riser which leads to the FCC reactor, in the feed to the furnace that produces the hot feed or in the feed to the pre-heat heat exchanger arrangement which produces the feed to the furnace. If added at this last-named injection point, some of the additive forms a thin coating over the heat exchanger surfaces.

The additive composition of this invention, as noted, comprises at least one overbase complex of a salt and an organic acid complexing agent. The exact structure of overbases is not well understood. It has been suggested that they comprise dispersions of salts formed by contacting an acidic material with an excess of a basically reacting metal compound; e.g., a metal hydroxide or oxide. Alternatively, it has been suggested that they comprise "polymeric salts". It is believed that neither theory is incorrect but that neither is completely correct. In accordance with the present invention, it is believed that the preparation of an "overbased" material results in an "overbase complex" of a metal oxide or carbonate with an organic acid dispersant or stabilizer; i.e., "complexing agent". The nature of the complex so formed is not completely understood.

Accordingly, as used in the present specification, a composition is an overbase complex of an oxide or carbonate of Mg, Ca, Ba, Sr or Mn and the Mg, Ca, Ba, Sr or Mn salt of an organic acid "complexing agent". In this application, it has been found that the magnesium species yields especially effective results and it is theorized that aluminum species alone or in combination with Mg would yield good results as well. Thus, as contemplated herein, overbases include the aluminum species. The additive composition contains a stoichiometric excess of basic metal compound, relative to the number of equivalents of acid complexing agent which is reacted with a basic metal compound to afford the complex, relative to the normal stoichiometry of the particular metal base and acid. For example, a "neutral" or "normal" metal salt of an acid is characterized by an equivalent ratio of base or "metal" to acid of 1:1, while an overbased salt is characterized by a higher ratio; e.g., 1.1:1, 2:1, 5:1, 10:1, 15:1, 20:1, 30:1 and the like. The term "metal ratio" is used to designate the ratio of (a) equivalents of metal or base to acid in an overbased salt to (b) the number of equivalents expected to be present in a normal salt, based on the usual stoichiometry of the metal or metals involved and the acid of acids present. Thus, an oil dispersion of an overbased magnesium salt containing two equivalents of acid and twenty equivalents of magnesium would have a metal ratio of 10; i.e., 20÷(1+1).

In the present specification, magnesium, for example, is regarded as having two equivalents of base per atomic weight; magnesium oxide (MgO) and magnesium hydroxide ($Mg(OH)_2$), two equivalents per mole. Monobasic organic acids are regarded as having one equivalent of acid per acidic hydrogen or acid group. Thus, a monocarboxylic acid or monosulfonic acid or their equivalent derivatives, such as esters and ammonium and metal salts, have one equivalent per mole of acid, ester or salt; a disulfonic aid or dicarboxylic acid, or equivalent derivative, has two equivalents per mole. The basically reacting metal compounds such as the oxides and carbonates of calcium, barium and magnesium have two equivalents per mole; i.e., two equivalents per atomic weight of metal.

The additive compositions of the invention are overbase complexes of magnesium or aluminum oxides and/or carbonates and a magnesium or aluminum salt of at least one complexing agent. The oxides or carbonates may also be a combination of the magnesium and aluminum species, such as a 1:1 by weight mixture. Likewise, the salt may be a combination of magnesium and aluminum salts, such as a 1:1 by weight mixture. However, the magnesium species are highly preferred.

Hereinafter, for want of better terms, "carboxylate" refers to the reaction product of a metal base and an organic carboxylic acid having the general formula R—COOH, where R is a hydrocarbon radical, and "non-carboxylate" refers to the reaction product of a metal base and an organic acid other than an organic carboxylic acid; e.g., "non-carboxylic" acids such as organic sulfur acids and organic phosphorus acids, which latter materials have substantially greater dispersant capabilities than do the carboxylates, the carboxylates, however, having stabilizing capabilities.

The role of the complexing agent in the preparation and use of the additive compositions of the invention is not clear. As stated above, some may function as stabilizers while others may function as dispersants. Certainly, some may have both functions or another, unknown, function. It appears, however, that, during the preparation of the complex, the presence of at least one complexing agent is essential to provide the complex additive compositions used in the methods of the invention. It also appears that the preferred additive compositions are characterized by the presence of a non-carboxylate salt; e.g., a sulfonate.

The additive compositions used in the present invention may be prepared in any manner known to the prior art for preparing overbased salts, providing that the magnesium oxide/magnesium carboxylated overbase complex resulting therefrom is in the form of finely divided, preferably submicron, particles which form a stable dispersion in oil. Thus, the method for preparing the magnesium oxide/magnesium carboxylated overbase complex is to form a mixture of a base of the desired metal; e.g., Mg(OH), a complexing agent; e.g., fatty acid such as a tall oil fatty acid, which is present in a quantity much less than that required to stoichiometrically react with the hydroxide, and a non-volatile diluent. The mixture is heated to a temperature of about 250°–350° C., whereby there is afforded the overbase complex of the metal oxide and metal salt of the fatty acid as set forth in U.S. Pat. No. 4,163,728 (the '728 patent). The metal carbonate/complexing agent overbase complex; e.g., magnesium carbonate/magnesium sulfonate, is commercially available or may be prepared in the same manner as described above, except that carbon dioxide is bubbled through the initial reaction mixture.

The above-described method of preparing the overbased magnesium oxide/magnesium carboxylate of the present invention is particularly set forth in the '728 patent, which is incorporated herein by reference in its entirety and made a part hereof, wherein, for example, a mixture of $Mg(OH)_2$ and a carboxylic acid complexing agent is heated at a temperature of about 280°–330° C. in a suitable non-volatile diluent.

Complexing agents which are used in the processing aids of the present invention are carboxylic acids, phenols, organic phosphorus acids and organic sulfur acids. Included are those acids which are presently used in preparing overbased materials; e.g., those described in U.S. Pat. Nos. 3,312,618; 2,695,910 and 2,616,904, and constitute an art-recognized class of acids. The carboxylic acids, phenols, organic phosphorus acids and organic sulfur acids which are oil-soluble per se, particularly the oil-soluble sulfonic acids, are especially useful. Oil-soluble derivatives of these organic acidic substances, such as their metal salts, ammonium salts and esters (particularly esters with lower aliphatic alcohols having up to six carbon atoms, such as the lower alkanols), can be utilized in lieu of or in combination with the free acids. When reference is made to the acid, its equivalent derivatives are implicitly included unless it is clear that only the acid is intended.

Suitable carboxylic acid complexing agents which may be used herein include aliphatic, cycloaliphatic and aromatic mono and polybasic carboxylic acids such as naphthenic acids, alkyl- or alkenyl-substituted cyclopentanoic acids, alkyl- or alkenyl-substituted cyclohexanoic acids and alkyl- or alkenyl-substituted aromatic carboxylic acids. The aliphatic acids generally are long chain acids and contain at least eight carbon atoms and preferably at least twelve carbon atoms. The cycloaliphatic and aliphatic carboxylic acids can be saturated or unsaturated. Specific examples include 2-ethylhexanoic acid, alphalinolenic acid, propylene-tetramer-substituted maleic acid, behenic acid, isostearic acid, pelargonic acid, capric acid, palmitoleic acid, linoleic acid, lauric acid, oleic acid, ricinoleic acid, undecyclic acid, dioctylcyclopentane carboxylic acid, myristic acid, dilauryldecahydronaphthalene carboxylic acid, stearyloctahydroindene carboxylic acid, palmitic acid, commercially available mixture of two or more carboxylic acids such as tall oil fatty acids, rosin acids and the like. Also included as representative acids are saturated aliphatic monocarboxylic acids; e.g., formic, acetic, propionic, butyric, valeric, caproic, heptanoic, caprylic, pelargonic, capric, undecyclic, lauric, tridecylic, myristic, isoacetic, palmitic, margaric and stearic; alicyclic unsaturated monocarboxylic acids; e.g. hydnocarpic and chaulmoogric; saturated aliphatic dicarboxylic acids; e.g., oxalic, malonic, succinic, glutaric, adipic, pimelic, suberic, azelaic and sebacic; alicyclic saturated dicarboxylic acids; e.g., cyclohexane dicarboxylic acid; unsaturated aliphatic monocarboxylic acids; e.g., acrylic, crotonic, decenoic, undecenoic, tridecenoic, pentadecenoic, oleic, linoleic and linolenic; unsaturated dicarboxylic acids; e.g., fumaric and maleic.

Aromatic acids which are used in the preparation of the additive compositions are represented by the general formula:

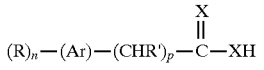

where R is a hydrocarbon or essentially hydrocarbon radical containing at least four aliphatic carbon atoms, R' is hydrogen or C(X)XH, n is an integer of from one to four, Ar is a polyvalent aromatic hydrocarbon radical having a total of up to fourteen carbon atoms in the aromatic nucleus, each X is independently a divalent sulfur or oxygen group and p is zero or an integer of from one to six, with the proviso that R and n are such that there is an average of at least eight aliphatic carbon atoms provided by the R substituents for each acid molecule represented. Examples of aromatic radicals represented by the variable Ar are the polyvalent aromatic radicals derived from benzene, naphthalene, anthracene, phenanthrene, indene, fluorene, biphenyl and the like. Generally, the radical represented by Ar will be a polyvalent radical derived from benzene or naphthalene such as phenylenes and naphthalene; e.g., methylphenylenes, mercaptophenylenes, N,N-diethylaminophenylenes, chlorophenylenes, dipropoxynaphthylenes, triethylnaphthylenes, and similar tri-, tetra- and pentavalent radicals thereof.

The R variables are usually hydrocarbon groups, preferably aliphatic hydrocarbon groups such as alkyl or alkenyl radicals. However, the R groups can contain such substituents as phenyl, cycloalkyl; e.g., cyclohexyl, cyclopentyl, etc., and non-hydrocarbon groups such as nitro, amino, halo; e.g., chloro, bromo, etc., lower alkoxy, lower alkyl mercapto, oxo substituents; i.e., =O, thio groups; i.e., =S, interrupting groups such as —NH—, —O—, —S— and the like, provided the essentially hydrocarbon character of the R variable is retained. Examples of R groups include butyl, isobutyl, octyl, nonyl, dodecyl, docosyl, tetracontyl, t-chlorohexyl, 4-ethoxypentyl, 4-hexenyl, 3-cyclohexyloctyl, 4-(p-chlorophenyl)-octyl, 2,3,5,-trimethyl, 4-ethyl-5-methyloctyl and substituents derived from polymerized olefins such as polychloroprenes, polyethylenes, propypropylenes, polyisobutylenes, ethylenepropylene copolymers, chlorinated olefin polymers, oxidized ethylene-propylene copolymers and the like. Likewise the variable Ar may contain non-hydrocarbon substituents, for example, such diverse substituents as lower alkoxy, lower alkyl mercapto, nitro, halo, alkyl or alkenyl groups of less than four carbon atoms, hydroxy, mercapto and the like.

Another group of aromatic carboxylic acids are those of the formula:

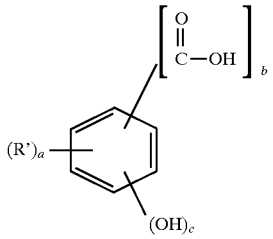

where R' is an aliphatic hydrocarbon radical containing at least four carbon atoms, a is an integer of from 1 to 3, b is 1 or 2, c is zero, 1 or 2 and preferably 1, with the proviso that R' and a are such that the acid molecules contain at least an average of about twelve aliphatic carbon atoms in the aliphatic hydrocarbon substituents per acid molecule.

Phenols which are used include 3,5,5-trimethyl-n-hexyl phenol, n-decyl phenols, cetyl phenols, nonyl phenols, alkylphenol phenols, resorcinol, octyl catechol, triisobutyl pyrogallol, alkyl alpha naphthol and the like.

Other acids, like the phenols; i.e., "non-carboxylic acids", which may be used in preparing the processing aids are the organic sulfur acids; e.g., oil-soluble sulfonic acids, including the synthetic oil-soluble sulfonic acids. Suitable oil-soluble sulfonic acids are represented by the general formula:

$$R_x\text{-T-}(SO_3H)_y \quad \text{I}$$

$$R'\text{—}(SO_3H)_y \quad \text{II}$$

In Formula I, T is a cyclic nucleus of the mono- or polynuclear type including benzenoid, cycloaliphatic or heterocyclic nuclei such as a benzene, naphthalene, anthracene, 1,2,3,4-tetrahydronaphthalene, thianthrene, cyclopentene, pyridine or biphenyl and the like. Ordinarily, however, T will represent an aromatic hydrocarbon nucleus, especially a benzene or naphthalene nucleus. The variable R in the radical $R_x$ can be, for example, an aliphatic group such as alkyl, alkenyl, alkoxy alkoxyalkyl, carboalkoxyalkyl, an aralkyl group or other hydrocarbon or essentially hydrocarbon groups, while x is at least 1 with the proviso that the variables represented by the group $R_x$ are such that the acids are oil-soluble. This means that the groups represented by $R_x$ should contain at least about eight aliphatic carbon atoms and preferably at least about twelve aliphatic carbon atoms. Generally x will be an integer of 1–3. The variables r and y in Formulae I and II have an average value of one to about four per molecule.

The variable R' in Formula II is an aliphatic or aliphatic-substituted cycloaliphatic hydrocarbon or essentially hydrocarbon radical. Where R' is an aliphatic radical, it should contain at least about 8 to about 20 carbon atoms and where R' is an aliphatic-substituted cycloaliphatic group, the aliphatic substituents should contain about 4 to 16 carbon atoms. Examples of R' are alkyl, alkenyl and alkoxyalkyl radicals and aliphatic-substituted cycloaliphatic radicals wherein the aliphatic substituents are alkoxy, alkoxyalkyl, carboalkoxyalkyl, etc. Generally the cycloaliphatic radical will be a cycloalkane nucleus or a cycloalkene nucleus such as cyclopentane, cyclohexane, cyclohexene, cyclopentene and the like. Specific examples of R' are cetyl-cyclohexyl, laurylcyclohexyl, cetyloxyethyl and octadecenyl radicals, and the radicals derived from petroleum, saturated and unsaturated paraffin wax, and polyolefins, including polymerized mono- and diolefins containing from about 1 to 8 carbon atoms per olefin monomer unit. The groups T, R and R' in Formulae I and II can also contain other substituents such as hydroxy, mercapto, halogen, nitro, amino, nitroso, carboxy, lower carbalkoxy, etc., as long as the essentially hydrocarbon character of the groups not destroyed.

The sulfonic acids which are preferred for use herein include alkyl sulfonic acids, alkaryl sulfonic acids, aralkyl sulfonic acids, dialkyl sulfonic acids, dialkylaryl sulfonic acids, aryl sulfonic acids; e.g., ethylsulfonic acid, benzenesulfonic acid, dodecylbenzenesulfonic acid and more complex sulfonic acid mixtures such as mahogany sulfonic acids and petroleum sulfonic acids.

Further, illustrative examples of the sulfonic acids are mahogany sulfonic acids, petrolatum sulfonic acids, mono- and polywax-substituted naphthalene sulfonic acids, cetylchlorobenzenesulfonic acids, cetylphenol sulfonic acids, cetylphenol disulfide sulfonic acids, cetoxycaprylbenzene sulfonic acids, dicetyl thianthrene sulfonic acids, di-lauryl betanaphthol sulfonic acids, dicapryl nitronaphthylene sulfonic acids, paraffin wax sulfonic acids, unsaturated paraffin wax sulfonic acids, hydroxy-substituted paraffin wax sulfonic acids, tetraisobutylene sulfonic acids, tetraamylene sulfonic acids, chloro-substituted paraffin wax sulfonic acids, nitrosyl-substituted paraffin wax sulfonic acids, petroleum naphthene sulfonic acids, cetylcyclopentyl sulfonic acids, lauryl cyclohexyl sulfonic acids, mono- and polywax-substituted cyclohexyl sulfonic acids and the like.

As used herein, the terminology "petroleum sulfonic acids" or "petrosulfonic acids" is intended to cover that well-known class of sulfonic acids derived from petroleum products according to conventional processes such as disclosed in U.S. Pat. Nos. 2,490,638; 2,483,800; 2,717,265; 2,726,261; 2,794,829; 2,832,801; 3,225,086; 3,337,613; 3,351,655 and the like. Sulfonic acids falling within Formulae I and II are disclosed in prior U.S. Pat. Nos. 2,616,904; 2,616,905; 2,273,234; 2,723,235; 2,723,236; 2,777,874 and the other U.S. patents referred to in each of these patents. Thus it is seen that these oil-soluble sulfonic acids are well-known in the art and require no further discussion herein.

Organic phosphorus acids used herein are characterized by at least one oil-solubilizing group attached directly to phosphorus via a carbon atom; e.g., oil-soluble phosphoric, phosphinic and phosphonic acids including the oil-soluble thiophosphoric, thiophosphinic and thiophosphonic acids. Preferred phosphorus acids are the alkyl- and dialkyl phosphoric and phosphonic acids and those prepared by reacting olefins with phosphorus sulfides; e.g., phosphorus pentasulfide. Steam-treated reaction products of phosphorus pentasulfide and polyolefins, such as polyisobutylene and polypropylene, are also useful. Such acids are well-known as shown by U.S. Pat. Nos. 2,316,078; 2,315,080; 2,316,091; 2,367,468; 2,375,315; 2,377,955; 2,496,508; 2,507,731; 2,516,119; 2,597,750; 2,647,889; 2,688,612 and 2,915,517.

Of course, mixtures of the above-described organic acids and derivatives thereof may be employed in preparing the additive compositions used in the methods of this invention.

Overbase complex types which are the preferred additive compositions of the invention are the following:

MgO/Mg carboxylate $MgCO_3$/Mg carboxylate

MgO/Mg non-carboxylate $MgCO_3$/Mg non-carboxylate

Corresponding aluminum versions are believed to be suitable candidates as well.

The use of the terms "carboxylate" and "non-carboxylate" refers, as stated supra, to the partial reaction product of a base of the desired metal and a carboxylic or non-carboxylic acid complexing agent which affords a complex believed to be a dispersion of finely divided metal oxide (or carbonate) associated with the metal carboxylate or metal non-carboxylate.

Of course, more than one oxide or carbonate may be associated with a complexing agent to afford complexes, for example, of the type MgO/$MgCO_3$/Mg-non-carboxylate, and more than one complexing agent may be combined with an oxide or carbonate to afford complexes, for example, of the type MgO/Mg carboxylate/Mg-non-carboxylate and $MgCO_3$/carboxylate/Mg-non-carboxylate. Corresponding aluminum versions are believed to be possible alternatives.

Additionally, mixed overbase complexes are included; e.g., MgO/Mg carboxylate with MgO/Mg non-carboxylate, $MgCO_3$/carboxylate with $MgCO_3$ non-carboxylate, MgO/Mg carboxylate with $MgCO_3$/non-carboxylate, etc. Again, corresponding aluminum versions are believed to be possibilities as well.

Especially preferred of the above types are:

MgO/Mg carboxylate $MgCO_3$/Mg sulfonate $MgCO_3$/Mg carboxylate

MgO/Mg sulfonate+$MgCO_3$M carboxylate

MgO/$MgCO_3$M carboxylate

MgO/$MgCO_3$/Mg sulfonate

The most preferred complexes are the following:

MgO/Mg fatty acid carboxylate (especially "tall oil" fatty acid carboxylates)

MgO/Mg benzenesulfonate or dodecylbenzenesulfonate $MgCO_3$/Mg fatty acid carboxylate $MgCO_3$/Mg benzenesulfonate or dodecylbenzenesulfonate MgO/Mg fatty acid carboxylate+MgO/Mg benzenesulfonate or dodecylbenzene sulfonate $MgCO_3$/Mg fatty acid carboxylate+$MgCO_3$/Mg benzenesulfonate or dodecylbenzenesulfonate MgO/$MgCO_3$/Mg fatty acid carboxylate MgO/$MgCO_3$/Mg benzenesulfonate or dodecylbenzenesulfonate The mixed overbase complexes; e.g., MgO/Mg fatty acid carboxylate+$MgCO_3$/Mg benzenesulfonate, are in a weight ratio to each other of from about 0.25/10 to about 10/0.25.

As described in the '728 patent, referred to earlier, the reaction of metal base and acid affords a product which undergoes decomposition to afford minute particles of metal oxide or carbonate in associate with the metal salt of the acid. The minute particles immediately become suspended and stabilized by the metal salt of the acid. The particles of metal oxide or metal carbonate are of a size no greater than about 2 microns in diameter, for example, not greater than about 1 micron but, preferably no greater than about 0.1 micron and, especially, should be less than 0.1 micron in diameter.

As described in the '728 patent, the preparation of a stable, fluid magnesium dispersion comprises decomposing a magnesium carboxylate to MgO in a non-volatile process fluid capable of being heated to the decomposition temperature of the magnesium carboxylate also containing a dispersant capable of retaining the magnesium oxide formed by the decomposition in stable suspension at a temperature greater than about 230° C., the process containing less than a stoichiometric amount of carboxylate, based on $Mg(OH)_2$ or equivalent. The magnesium oxide dispersion can be further reacted, after decomposition, with CO to form $MgCO_3$ dispersions, with water to form $Mg(OH)_2$ dispersions, etc.

The overbases by nature, therefore, are colloidal dispersions that may be added as "liquids" to the FCC feed streams as discussed above. Upon addition to the FCC feed streams, the overbases have been found to disperse easily and to tend to remain well-dispersed. In this sense, the overbases are "oil-soluble" in that they form well-dispersed colloidal suspensions in the treated FCC feed streams.

The amount of additive which is used will vary, depending on the environment of the area, the vanadium concentration of the FCC feed stream being treated and whether the feed stream is treated before or after the pre-heat heat exchanger(s). Generally, at least about 0.5 ppm by weight of available magnesium per 1 ppm by weight vanadium is desired. However, at least 1 ppm by weight available magnesium per 1 ppm by weight vanadium is preferred due to possible inefficiencies, especially if the additive is incorporated before the pre-heat heat exchanger(s), where some of the overbase is lost to the formation of a coating on the heat exchanger(s). Approximately the same amount of aluminum overbase as magnesium overbase would be utilized in situations in which the aluminum version is employed. In general, an amount of additive is used which is effective for improving conversion. This is referred to herein as an "effective amount". Accordingly, there may be used an amount of from about 5 ppm to about 1,000 ppm or more based on the weight of the FCC feed stream, depending on specific circumstances. Ordinarily, from about 25 ppm to about 500 ppm are effective, especially from about 50 to about 300 ppm. The vanadium contaminant usually has been found to be problematic as it results in a coating of several hundred to a thousand ppm or more by weight of the catalyst.

The concentrations of additive discussed above are generally maintained on a continuous basis. Thus, the additive is added continuously in an amount necessary to effect a constant concentration of, for example, from about 25 to about 500 ppm, especially from about 50 to about 300 ppm. For certain applications, however, the additive may be added in a single dose or on a semi-continuous basis. The additive may be added as a liquid or, in the case of addition to a gas stream, as a spray.

The additive overbase composition may be used alone, as the sole metal passivator, or in combination with other metal passivators, as desired. For example, another metal passivator, such as any of the well known antimony compounds for passivating nickel, may be injected into the hot hydrocarbon at a point separate from the injection point of the subject overbase compositions. Alternatively, if the other metal passivator is compatible with the overbase composition, for example, if an oil-soluble rather than water-soluble antimony composition for passivating nickel is chosen, the other passivator may be incorporated into the overbase composition (e.g., the antimony composition may be added to or otherwise mixed with the overbase composition), and the resulting combination of metal passivators may be injected together into the hot hydrocarbon. The second metal passivator, such as an antimony compound, is desirably employed in an amount effective to passivate the metal of concern, such as nickel, in the hot hydrocarbon, in view of the metal concentration therein.

The following example illustrates specific, non-limiting embodiments of the invention, including the best mode of practice of the invention.

EXAMPLE

A bench scale test simulating a fluid catalytic cracking unit was conducted to determine the effect of the process aid in catalyst activity and cracking efficiency. The test, a Microactivity Test (MAT), is a standard bench scale test generally used by refineries.

In the test, five (5) runs were made. Runs 3596 and 3597 contained no process aid and the catalyst (Engelhard Eq. Ultrasiv-280) used in each run was plant regenerated equilibrium catalyst which was added as fresh catalyst for each run. The catalyst had 1,000 ppm vanadium on it, based on the weight of the catalyst. Runs 3598, 3599 and 3600 each contained a process aid prepared by blending an overbased complex of magnesium oxide/magnesium salt of a tall oil fatty acid prepared as set forth in the '728 patent with a commercially available overbased complex of magnesium carbonate/magnesium sulfonate, which contained 62 ppm magnesium in fresh feed. The catalyst in Run 3598 was also plant regenerated equilibrium catalyst which was regenerated and used in Run 3599 and then regenerated again and used in Run 3600.

The data generated are shown below:

TABLE

Effect of Feed Containing Process Aid on MAT Runs

| | Untreated | | Treated | | |
|---|---|---|---|---|---|
| Run Number | 3596 | 3597 | 3598 | 3599 | 3600 |
| Date | 07/31/87 | 07/31/87 | 08/03/87 | 08/04/87 | 08/05/87 |
| | Engelhard Eq. Ultrasiv-280 | | | | |
| Catalyst | | | | | |
| Vol., M1 (Catalyst) | 2.5 | 2.5 | 2.5 | 2.5 | 2.5 |
| Charge* | Cinn. G.O. | Cinn. G.O. | Cinn. G.O. | Cinn. G.O. | Cinn. G.O. |
| Temp. °C. Start | 515 | 515 | 515 | 515 | 515 |
| Low | 491 | 494 | 497 | 499 | 499 |
| Time, Sec. | 80.00 | 80.00 | 80.00 | 80.00 | 80.00 |
| Conversion, Vol. % | 67.61 | 66.52 | 71.36 | 67.29 | 69.42 |
| | Product Yields, Vol. % | | | | |
| Total $C_3$'s | 6.03 | 6.15 | 7.13 | 6.61 | 6.55 |
| Propane | 1.19 | 1.21 | 1.51 | 1.27 | 1.25 |
| Propylene | 4.84 | 4.93 | 5.71 | 5.34 | 5.30 |
| Total $C_4$'s | 10.54 | 10.51 | 11.94 | 11.29 | 11.31 |
| I. Butane | 4.56 | 4.45 | 5.07 | 4.74 | 4.74 |
| N. Butane | .85 | .87 | 1.03 | .90 | .90 |
| Total Butanes | 5.12 | 5.19 | 5.84 | 5.65 | 5.67 |
| Butanes | 2.32 | 2.38 | 2.67 | 2.57 | 2.59 |
| Trans-Butenes | 1.64 | 1.64 | 1.85 | 1.80 | 1.80 |
| Cis-Butenes | 1.17 | 1.17 | 1.32 | 1.28 | 1.29 |
| $C_5$ - 430° F. Gaso. | 56.35 | 55.82 | 58.79 | 58.07 | 56.73 |
| 430–650° F. LCGO | 21.55 | 21.73 | 19.76 | 21.58 | 20.28 |
| 650° F + DO | 10.84 | 11.75 | 8.88 | 11.14 | 10.29 |
| $C_3$ + Liq. Rec. | 105.30 | 105.96 | 106.60 | 108.68 | 105.16 |
| FCC Gaso + Alk. | 73.93 | 73.70 | 79.17 | 77.46 | 76.10 |
| | Product Yields, Wt. % | | | | |
| $C_2$ & Lighter | 1.45 | 1.62 | 1.92 | 1.74 | 1.72 |
| $H_2$ | .12 | .13 | .17 | .15 | .16 |
| $H_2S$ | .00 | .00 | .00 | .00 | .00 |
| Methane | .40 | .47 | .54 | .47 | .46 |
| Ethane | .44 | .48 | .59 | .52 | .51 |
| Ethylene | .49 | .54 | .63 | .60 | .58 |
| Carbon | 2.54 | 2.51 | 2.46 | 2.62 | 2.92 |
| Wt. Balance | 96.43 | 97.28 | 96.82 | 99.42 | 96.42 |

*Cincinnati Gas Oil

As can be seen from the results of the MAT test, Runs 3598, 3599 and 3600 show increased light olefins; e.g., $C_4$'s which can be used in alkylation feed to make octane-improving gasoline components, and gasoline yields, reduced 345° C. product yield and increased conversion of lighter products.

While the illustrative embodiments of the invention have been described here and above with particularity, it will be understood that various other modifications will be apparent to and can be readily made by those skilled in the art without departing from the spirit and scope of the invention. Accordingly, it is not intended that the scope of the claims appended hereto be limited to the examples and description set forth herein but rather that the claims be construed as encompassing all the features of patentable novelty which reside in the present invention, including all features which would be treated as equivalents thereof by those skilled in the art to which the invention pertains.

What is claimed is:

1. A method for improving conversion in a fluidized catalytic cracking unit feed stream containing vanadium, comprising incorporation into the feed stream an effective conversion improving amount of a liquid composition comprising at least one overbase complex of a salt and an organic acid complexing agent, the salt being selected from the group consisting of magnesium salts, aluminum salts and mixtures thereof.

2. A method as set forth in claim 1 wherein the salt is a magnesium salt.

3. A method as set forth in claim 2 wherein each complex is an oil-stable, colloidal dispersion.

4. A method as set forth in claim 3 wherein each complex forms a colloidal dispersion in the feed stream.

5. A method as set forth in claim 4 wherein the feed stream contains a concentration of vanadium and the effective amount of composition is sufficient to produce an overbase complex concentration at least about half the concentration of the vanadium on a weight basis.

6. A method as set forth in claim 2 wherein the fluidized catalytic cracking unit feed stream is a hot feed to a riser leading to a fluidized catalytic cracking reactor.

7. A method as set forth in claim 2 wherein the fluidized catalytic cracking unit feed stream is a feed to a furnace that produces a hot feed to a riser leading to a fluidized catalytic cracking reactor.

8. A method as set forth in claim 2 wherein the fluidized catalytic cracking unit feed stream is a pre-heat feed to a pre-heat heat exchanger arrangement that produces a feed to a furnace that in turn produces a hot feed to a riser leading to a fluidized catalytic cracking reactor.

9. A method as set forth in claim 2 wherein the salt is an oxide or carbonate of magnesium.

10. A method as set forth in claim 2 wherein the organic acid complexing agent is a carboxylic acid, a sulfur acid or a phosphorus acid.

11. A method as set forth in claim 2 wherein the composition is a complex of a magnesium salt and a magnesium salt of an organic acid complexing agent.

12. A method as set forth in claim 2 wherein the composition comprises:

a. at least one overbase complex of magnesium oxide and a magnesium salt of an organic acid complexing agent, and b. at least one overbase complex of magnesium carbonate and a magnesium salt of an organic acid complexing agent.

13. A method as set forth in claim 12 wherein the composition comprises:

a. an overbase complex of magnesium oxide and a magnesium salt of a fatty acid, and b. an overbase complex of magnesium carbonate and a magnesium salt of a sulfonic acid.

14. A method as set forth in claim 1 where the overbase complex is a first metal passivator and a second metal passivator is also incorporated into the feed stream.

15. A method as set forth in claim 14 wherein the second metal passivator is an antimony compound.

16. A method for scavenging vanadium in a fluidized catalytic cracking unit feed stream containing vanadium, comprising incorporation into the feed stream an effective conversion improving amount of a liquid composition comprising at least one overbase complex of a salt and an organic acid complexing agent, thereby to scavenge vanadium in the feed stream, the salt being selected from the group consisting of magnesium salts, aluminum salts and mixtures thereof.

17. A method as set forth in claim 16 wherein the salt is a magnesium salt.

18. A method as set forth in claim 17 wherein the composition comprises:

a. an overbase complex of magnesium oxide and a magnesium salt of a fatty acid, and b. an overbase complex of magnesium carbonate and a magnesium salt of a sulfonic acid.

19. A method for prolonging the life of a catalyst in a fluidized catalytic cracking unit feed stream containing vanadium, comprising incorporation into the feed stream an effective conversion improving amount of a liquid composition comprising at least one overbase complex of a salt and an organic acid complexing agent, thereby to prolong the life of the catalyst, the salt being selected from the group consisting of magnesium salts, aluminum salts and mixtures thereof.

20. A method as set forth in claim 19 wherein the salt is a magnesium salt.

21. A method as set forth in claim 20 wherein the composition comprises:

a. an overbase complex of magnesium oxide and a magnesium salt of a fatty acid, and b. an overbase complex of magnesium carbonate and a magnesium salt of a sulfonic acid.

* * * * *